US007941073B2

(12) United States Patent
Takagi et al.

(10) Patent No.: US 7,941,073 B2
(45) Date of Patent: May 10, 2011

(54) TONER CARTRIDGE

(75) Inventors: Seiichi Takagi, Minamiashigara (JP); Yasushige Nakamura, Ebina (JP); Takashi Hino, Tokyo (JP); Tsutomu Uezono, Saitama (JP); Masanori Murase, Minamiashigara (JP); Koichi Tanaka, Kashiwazaki (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 279 days.

(21) Appl. No.: 11/957,902

(22) Filed: Dec. 17, 2007

(65) Prior Publication Data

US 2008/0260441 A1 Oct. 23, 2008

(30) Foreign Application Priority Data

Apr. 20, 2007 (JP) ..... 2007-112151

(51) Int. Cl.
*G03G 15/08* (2006.01)

(52) U.S. Cl. ..... 399/120; 399/107; 399/111; 399/113; 399/119; 399/252; 399/253; 399/254; 399/255; 399/256; 399/258; 399/260; 399/262; 399/263

(58) Field of Classification Search ..... 399/120, 399/107, 111, 113, 116, 252, 253, 254, 255, 399/256, 258, 260, 262, 263; 222/DIG. 1
See application file for complete search history.

(56) References Cited

U.S. PATENT DOCUMENTS

| | | | | |
|---|---|---|---|---|
| 4,264,697 | A | 4/1981 | Perez et al. | |
| RE33,484 | E * | 12/1990 | Imanaka | 399/359 |
| 5,543,898 | A * | 8/1996 | Shishido et al. | 399/111 |
| 5,852,762 | A * | 12/1998 | Hatta et al. | 399/358 |
| 7,209,690 | B2 | 4/2007 | Koyanagi et al. | |
| 2002/0150405 | A1 * | 10/2002 | Tanisawa et al. | 399/120 |
| 2005/0214032 | A1 | 9/2005 | Koyanagi et al. | |
| 2005/0249522 | A1 * | 11/2005 | Park | 399/120 |
| 2006/0257175 | A1 * | 11/2006 | Endo et al. | 399/281 |

FOREIGN PATENT DOCUMENTS

| | | |
|---|---|---|
| JP | B2 36-10231 | 3/1934 |
| JP | A 54-080752 | 6/1979 |

(Continued)

OTHER PUBLICATIONS

Office Action issued in KR Application No. 10-2008-0005234 on Feb. 10, 2011 (with English translation).

*Primary Examiner* — David P Porta
*Assistant Examiner* — Shun Lee
(74) *Attorney, Agent, or Firm* — Oliff & Berridge, PLC

(57) ABSTRACT

The toner cartridge is provided with: a toner storing container of a rectangular shape having a toner feeding opening in an angular portion of the toner storing container; a stirring conveying member that is disposed so as to rotate in a predetermined rotation direction in the toner storing container and stirs and conveys toner in the toner storing container toward the toner feeding opening; a waste toner storing container that stores reclaimed toner; and a partition member that is held by the toner storing container, partitions between the toner storing container and the waste toner storing containers and has a bearing portion axially supporting a rotating shaft of the stirring conveying member and extending into inside of the waste toner storing container. The toner stored in the toner storing container has an average value of a shape factor (SF1) of about 130 or less.

9 Claims, 10 Drawing Sheets

FOREIGN PATENT DOCUMENTS

| | | |
|---|---|---|
| JP | B2 56-11461 | 3/1981 |
| JP | B2 56-13945 | 4/1981 |
| JP | A 56-052758 | 5/1981 |
| JP | A 58-134650 | 8/1983 |
| JP | A 59-053856 | 3/1984 |
| JP | A 59-061842 | 4/1984 |
| JP | A 59-127640 | 7/1984 |
| JP | A 59-127662 | 7/1984 |
| JP | A 60-057350 | 4/1985 |
| JP | A 61-018965 | 1/1986 |
| JP | A 61-019602 | 1/1986 |
| JP | A 61-061627 | 3/1986 |
| JP | A 61-249710 | 11/1986 |
| JP | A 62-039879 | 2/1987 |
| JP | A 63-235957 | 9/1988 |
| JP | A 63-249155 | 10/1988 |
| JP | A 02-167566 | 6/1990 |
| JP | A 03-179363 | 8/1991 |
| JP | A 05-107918 | 4/1993 |
| JP | A 05-281783 | 10/1993 |
| JP | B2 07-034126 | 4/1995 |
| JP | A 09-034175 | 2/1997 |
| JP | B2 3246394 | 11/2001 |
| JP | A 2002-006610 | 1/2002 |
| JP | A-2003-122104 | 4/2003 |
| JP | B2 3661422 | 4/2005 |
| JP | A-2005-283928 | 10/2005 |

* cited by examiner

TONER CARTRIDGE

CROSS REFERENCE TO RELATED APPLICATION

This application is based on and claims priority under 35 USC §119 from Japanese Patent Application No. 2007-112151 filed Apr. 20, 2007.

BACKGROUND

1. Technical Field

The present invention relates to a toner cartridge storing toner.

2. Related Art

As a toner cartridge used in an image forming apparatus of an electrophotographic system, there is used one configured so that a developer in a container is supplied to a developing device and simultaneously a waste developer containing a carrier and the like which are used and deteriorated In the developing process is reclaimed.

SUMMARY

According to an aspect of the invention, there is provided a toner cartridge including: a toner storing container of a rectangular shape having a toner feeding opening in an angular portion thereof; a stirring conveying member that is disposed so as to rotate in a predetermined rotation direction in the toner storing container and stirs and conveys toner in the toner storing container toward the toner feeding opening; a waste toner storing container that stores reclaimed toner; and a partition member that is held by the toner storing container, partitions between the toner storing container and the waste toner storing container, and has a bearing portion axially supporting a rotating shaft of the stirring conveying member and extending into inside of the waste toner storing container. The toner stored in the toner storing container has an average value of a shape factor (SF1) defined by a following equation (1) of about 130 or less.

$$SF1=100\times(\pi/4)\times(ML^2/S) \quad (1)$$

(Provided that in the equation (1), π (pi) represents circle ratio, ML represents an absolute maximum length of a toner particle, and S represents a projected area of the toner particle.)

BRIEF DESCRIPTION OF THE DRAWINGS

Exemplary embodiment(s) of the present invention will be described in detail based on the following figures, wherein.

DETAILED DESCRIPTION

Hereinafter, the present invention will be explained with reference to the preferred embodiment (the present exemplary embodiment) for carrying out the present invention. Further, the present invention is not limited to the present exemplary embodiments described below but may be carried out in various modified modes within the gist of the invention. Furthermore, the drawings used here may not represent the real size but are used to explain the present exemplary embodiments.

(Image Forming Apparatus)

Figure 1:
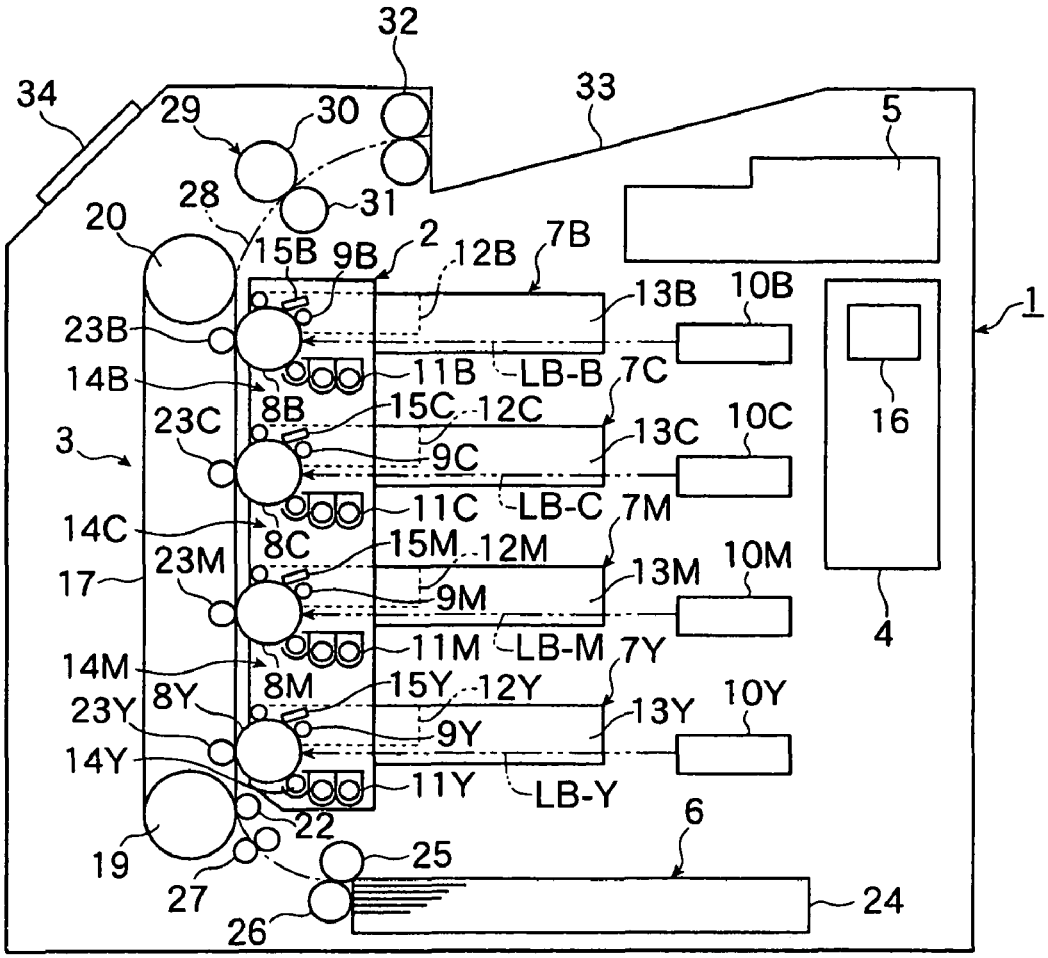
FIG. 1 is a configuration diagram showing the whole configuration of the image forming apparatus according to the present exemplary embodiment.
Figure 2:
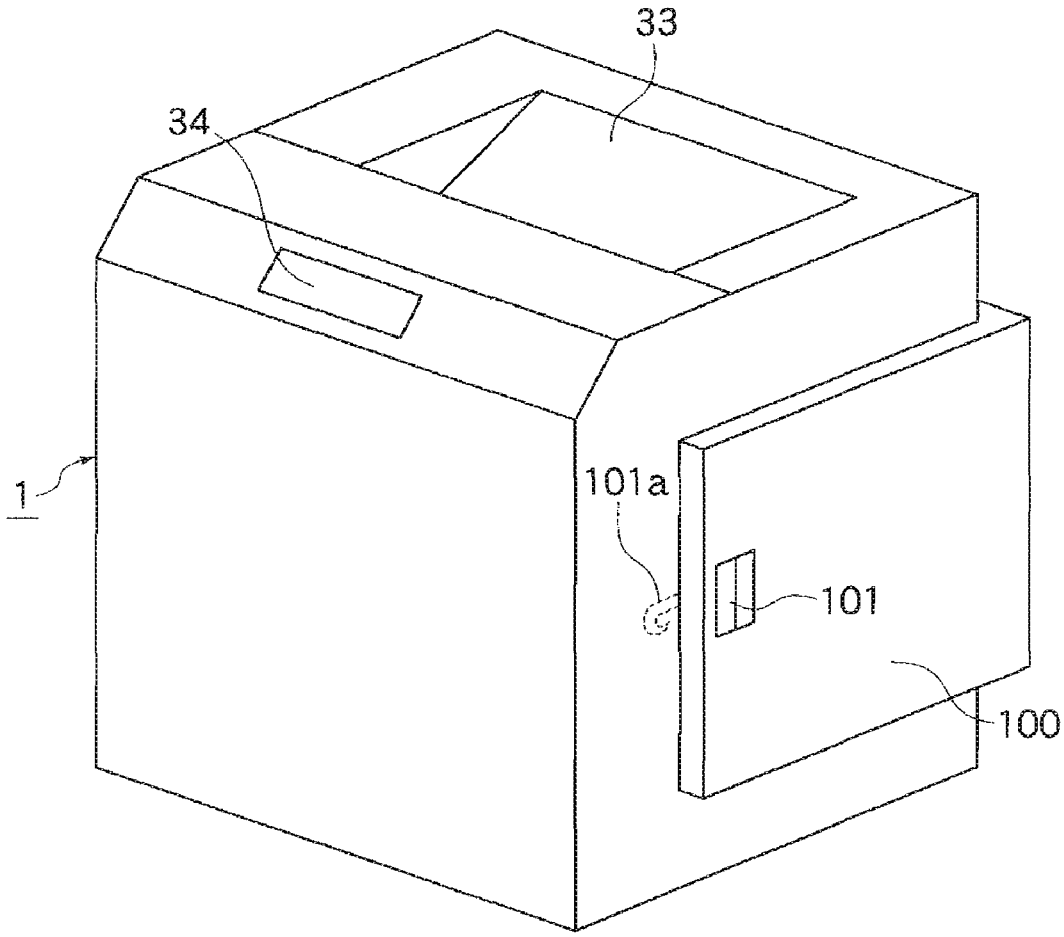
FIG. 2 is a perspective view showing an appearance of the image forming apparatus.
Figure 3:
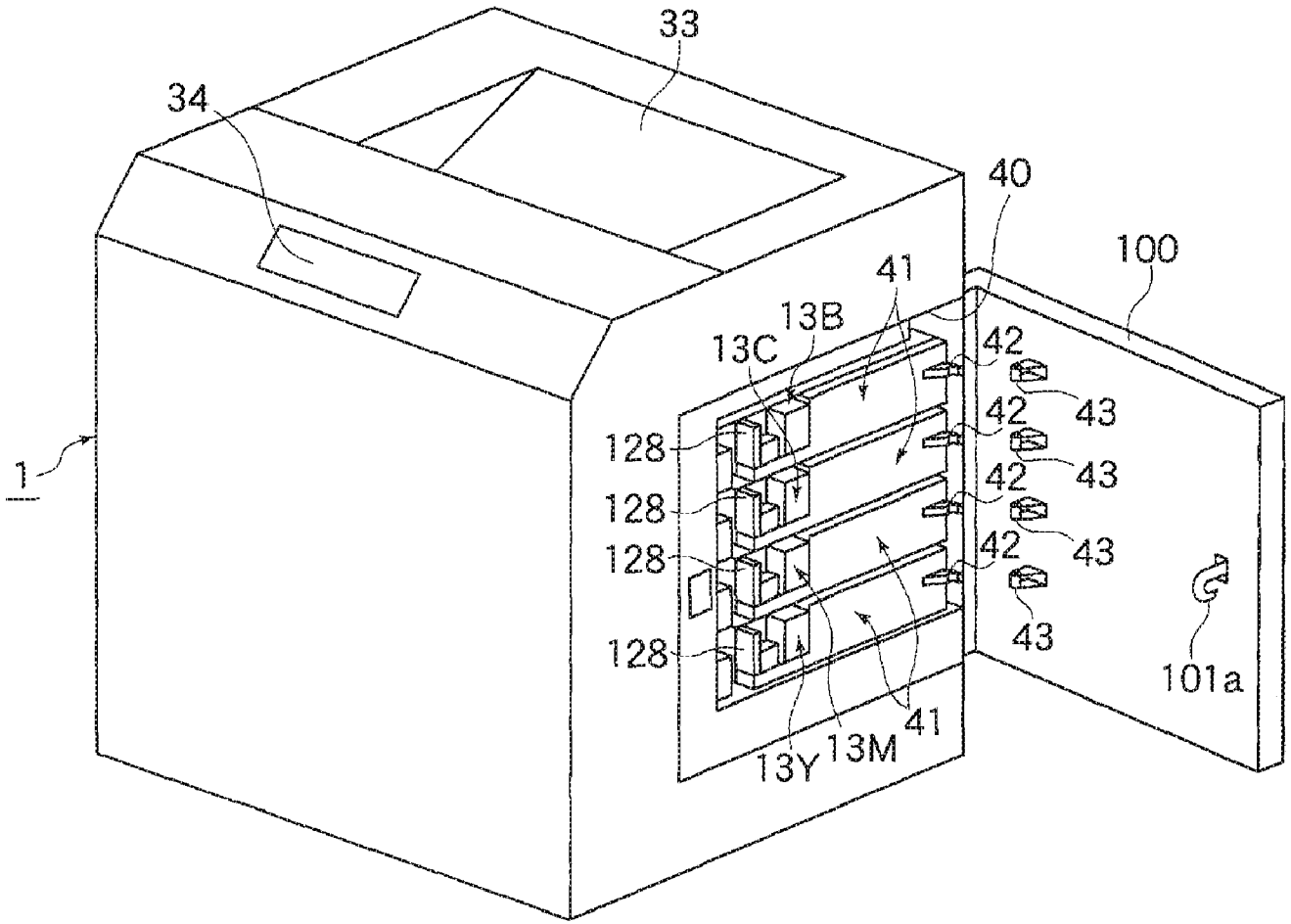
FIG. 3 is a perspective view snowing the state where the cover of the image forming apparatus is opened.

By using FIGS. 1 to 3, the whole configuration of an image forming apparatus relating to the present exemplary embodiment will be explained. FIG. 1 is a configuration diagram showing the whole configuration of the image forming apparatus according to the present exemplary embodiment. FIG. 2 is a perspective view showing an appearance of the image forming apparatus. FIG. 3 is a perspective view showing the state where the cover of the image forming apparatus is opened.

The image forming apparatus shown in FIGS. 1 to 3 has a body 1, and the inside of the body 1 of the image forming apparatus has an image forming unlit 2 and a paper conveying belt unit 3 which transfers toner images in plural colors formed by the image forming unit 2 along the up-and-down direction. In addition, the image forming apparatus has a control unit 4 equipped with a control circuit and the like, a power supply circuit unfit equipped with a high-voltage power supply circuit and a paper feeding device 6 which feeds a sheet of transfer paper as a transferring medium.

The image forming unit 2 has four image forming portions 7Y, 7M, 7C and 7B which form toner images of each color of yellow (Y), magenta (M), cyan (C) and black (B). The four image forming portions 7Y, 7M, 7C and 7B are disposed in series at given intervals along the up-and-down direction of the image forming apparatus.

The four image forming portions 7Y, 7M, 7C and 7B have a similar configuration. In other words, the image forming portions 7Y, 7M, 7C and 7B have a photoreceptor drum 8 (8Y, 8M, 8C and 8B) which holds a toner image, a charging roll 9 (9Y, 9M, 9C and 9B) which charges the surface of the photoreceptor drum 8 uniformly, an optical writing device 10 (10Y, 10M, 10C and 10B) which forms an electrostatic latent image by exposing an image corresponding to each color onto the surface of the photoreceptor drum 8, a developing device 11 (11Y, 11M, 11C and 11B) which develops the electrostatic latent image formed on the photoreceptor drum 8 with toner of the corresponding color, a cleaning device 12 (12Y, 12M, 12C and 12B) which cleans the transfer remaining toner remaining on the photoreceptor drum 8 and a toner cartridge 13 (13Y, 13M, 13C and 13B) which feeds toner to the developing device 11.

The developing device 11 feeds a two-component or one-component developer stored inside thereof to a developing roll 14 (14Y, 14M, 14C and 14B) while stirring the developer, and develops the electrostatic latent image formed on the photoreceptor drum 8 with toner of a predetermined color.

The cleaning device 12 removes the transfer remaining toner remaining on the surface of the photoreceptor drum 8 with a cleaning blade 15 (15Y, 15M, 15C and 15B). The transfer remaining toner removed is conveyed and stored inside of the cleaning device 12.

The control unit 4 is provided with, for example, an image processing system (IPS) 16 which performs predetermined image processing on image data. The image processing system 16 sequentially outputs image data of each color of yellow (Y), magenta (M), cyan (C) and black (B) into the optical writing device 10. The optical, writing device 10 irradiates four laser beams LB onto each of the photoreceptor drums 8Y, 8M, 8C and 8B depending on image data to form an electrostatic latent image by scan exposure.

The paper conveying belt unit 3 is equipped with a paper conveying belt 17 which circulates and moves. The paper conveying belt 17 conveys a sheet of transfer paper supplied by the paper feeding device 6 in a state of electrostatic absorption. The toner image of each color formed in each of the image forming portions 7Y, 7M, 7C and 7B is transferred onto the sheet of transfer paper. The paper conveying belt 17 is stretched with a predetermined tension force between a driving roll 19 (a tension roll) and a driven roll 20 which are disposed along the vertical direction. Further, the paper conveying belt 17 is rotated and moved at a given velocity in the clockwise direction by the driving roll 19 which is rotationally driven by a driving motor (not shown in the figure).

In addition, an adsorbing roll 22 is contacted with the surface of the driving roll 19 through the paper conveying belt 17, thus allowing the sheet of transfer paper to be adsorbed electrostatically to the surface of the paper conveying belt 17.

Transfer rolls 23Y, 23M, 23C and 23B superimposedly transfer the toner images of each color formed on the photoreceptor drums 8Y, 8M, 8C and 8B by overlapping them each other onto a sheet of transfer paper which is adsorbed to the surface of the paper conveying belt 17 and is conveyed.

The paper feeding device 6 is disposed at the bottom of the body 1 to feed a sheet of transfer paper. The paper feeding device 6 is equipped with a paper tray 24 for housing sheets of transfer paper with the desired size and quality. A feeding roll 25 feeds a sheet of transfer paper from the paper tray 24. A separating roll 26 separates sheets of transfer paper one by one. A resist roll 27 conveys a sheet of transfer paper to the adsorption position on the paper conveying belt 17 at a predetermined timing The sheet of transfer paper on which toner images of each color are superimposedly transferred is separated from the paper conveying belt 17 by the rigidity (so-called, stiffness) which the sheet of transfer paper by itself has and then is conveyed to a fixing device 29 along a conveying route 29. Then, the fixing device 29 fixes the toner images of each color on the sheet of transfer paper. The fixing device 29 is rotationally driven in a state where a heating roll 30 and a pressure belt 31 are brought into contact with each other with pressure, and the sheet of transfer paper is passed through a nip portion formed between the heating roll 30 and the pressure belt 31 and then is subjected to a fixing treatment with pressure and heat. Thereafter, the sheet of transfer paper on which toner images of each color are fixed is fed out on an exit tray 33 disposed on the upper side of the body 1 by an exit roll 32, and then, the printing operation is completed. Further, the body 1 is equipped with an operation panel 34 which displays a state of an image forming apparatus and performs a required operation and the like.

Each image forming portion 7Y, 7M, 7C or 7B is provided with each toner cartridge 13Y, 13M, 13C or 13B as a developer storing container which stores each toner fed into each developing device 11Y, 11M, 11C or 11E of each color.

As shown in FIG. 2, the toner cartridges 13Y, 13M, 130 and 13E of each color of yellow (Y), magenta (M), cyan (C) and black (B) may be replaced by opening an opening and closing cover 100 disposed on the side of the body 1. The opening and closing cover 100 is opened by releasing the locked state of a hook 101*a* by manually pulling a gripper 101.

As shown in FIG. 3, the toner cartridges 13Y, 13M, 13C and 13B are mounted on an opening portion 40 exposing to the side of the body 1 so as to be detachable in a state of being mounted on a cartridge holder 41. Each toner cartridge 13Y, 13M, 13C or 13B differs in color of toner stored but is basically equipped with a similar configuration.

As shown in FIG. 3, an arm 42 is turnably attached to the cartridge holder 41 in a state where the tip is protruded, and the tip engages with an engaged portion 43 disposed on the opening and closing cover 100. The cartridge holder 41 turns from the body 1 in conjunction with the opening operation of the opening and closing cover 100 and moves to the detaching position. The toner cartridges 13Y, 13M, 13C and 13B are fixed by operating a handle member 128 disposed on the toner cartridges 13Y, 13M, 13C and 13B in a state where the toner cartridges 13Y, 13M, 13C and 13B are mounted in the operating position in the opening portion 40 of the body 1.

(Toner Cartridge 13)

Next, the toner cartridge 13 (13Y, 13M, 13B and 13B) to which the present exemplary embodiment is applied will be described in detail.

Figure 4:
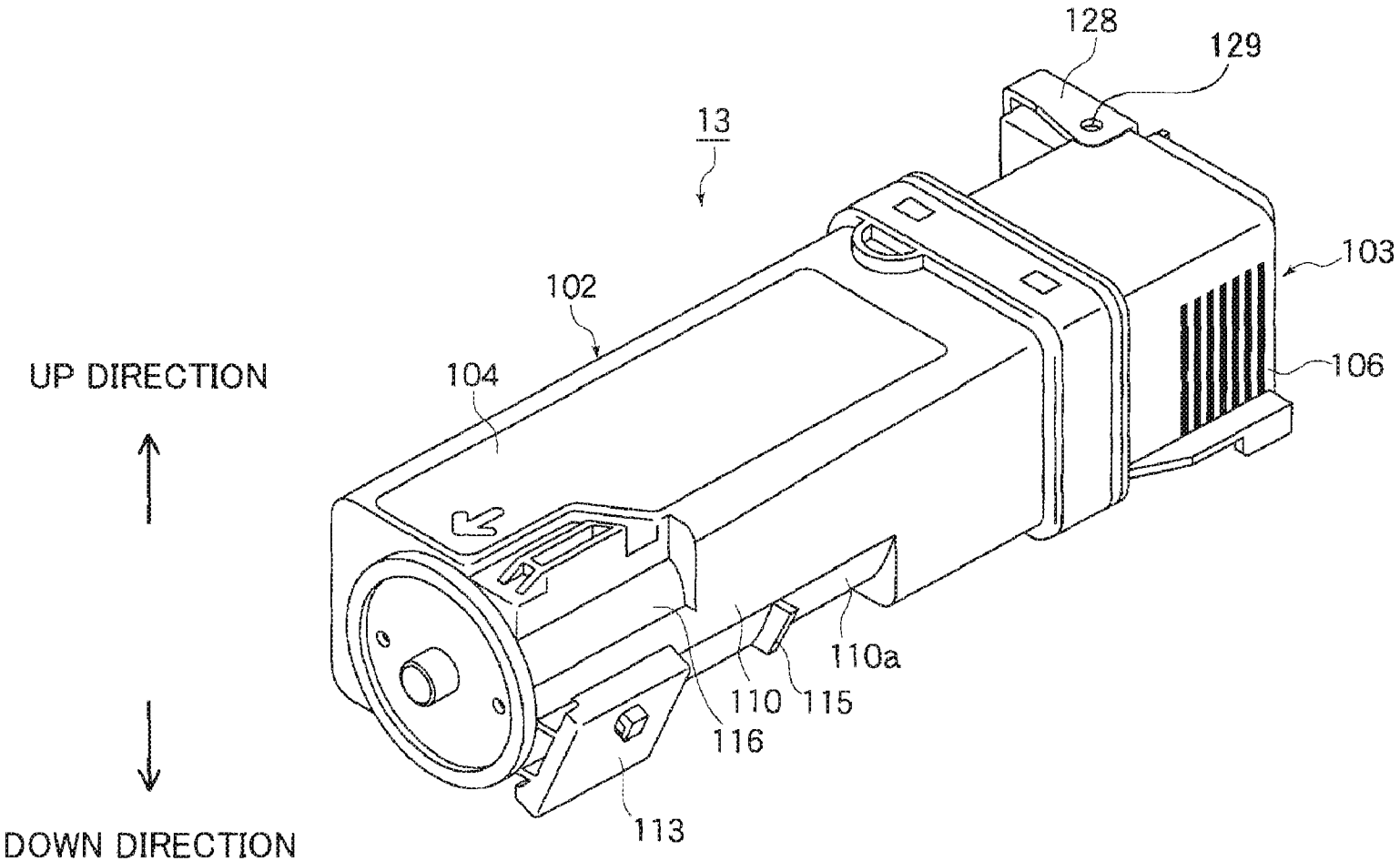
FIG. 4 is a perspective view showing an appearance of a toner cartridge according to the present exemplary embodiment.
Figure 5:
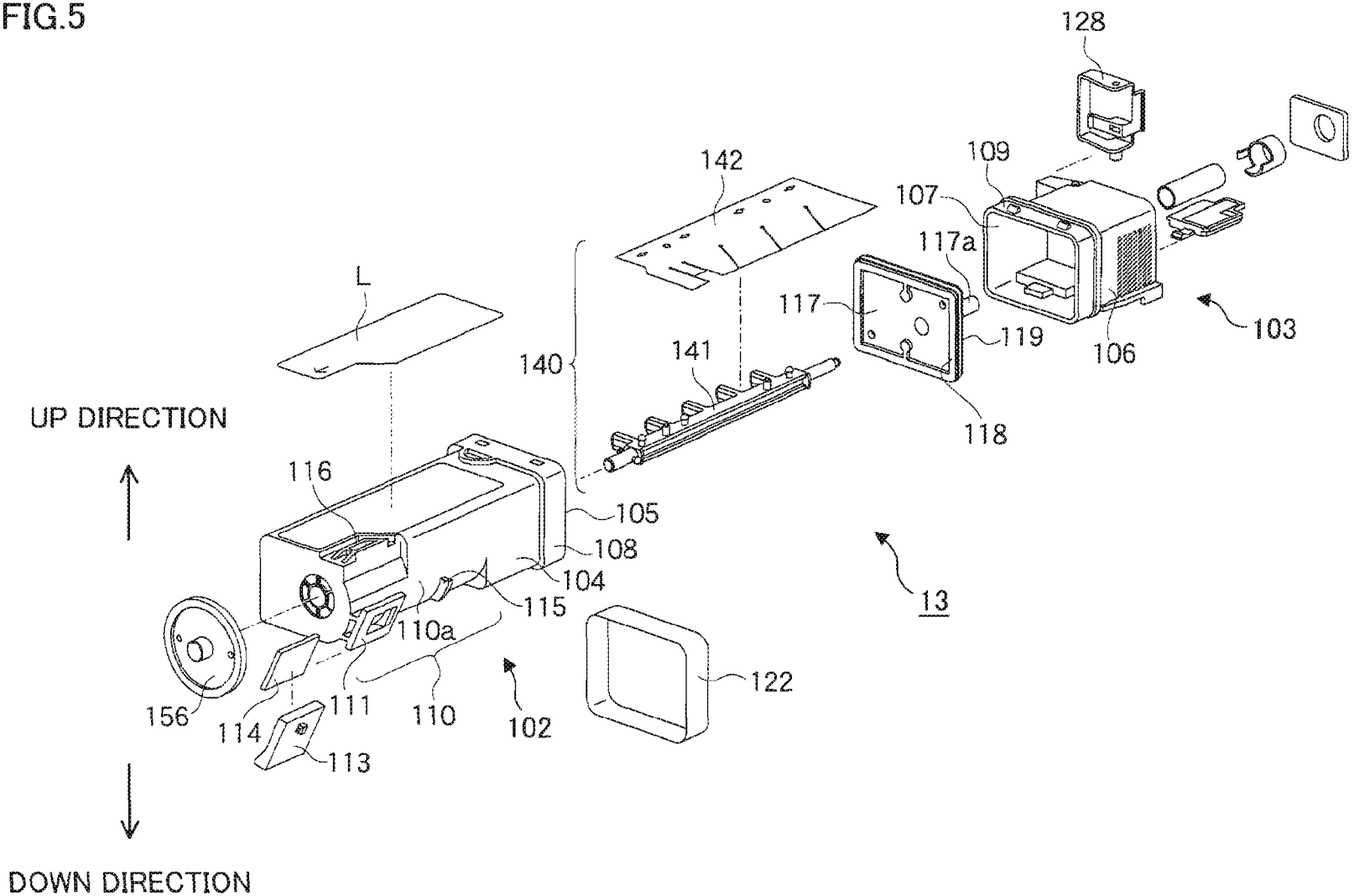
FIG. 5 is a configuration diagram showing a state where the toner cartridge is disassembled.

FIG. 4 is a perspective view showing an appearance of the toner cartridge 13 according to the present exemplary embodiment. Further, FIG. 5 is a configuration diagram showing a state where the toner cartridge 13 is disassembled.

As shown in FIG. 4, the toner cartridge 13 is configured as a box body of an elongated and rectangular-solid-like shape (a rectangular shape). The toner cartridge 13 has a feed toner storing portion 102 and a waste toner storing portion 103. The feed toner storing portion 102 stores a feed developer including new toner or a feed developer including new toner and a carrier. The waste toner storing portion 103 stores waste toner removed by the cleaning device 12, waste toner reclaimed from the developing device 11 or waste developer reclaimed from the developing device 11.

The feed toner storing portion 102 has a feed toner storing container 104 as a toner storing container which is a rectangular container. The waste toner storing portion 103 is provided with a waste toner storing container 106 which is a rectangular container connected to a longitudinal end of the feed toner storing container 104. The feed toner storing portion 102 has a larger volume than the waste toner storing portion 103.

The feed toner storing portion 102 is a box body of an elongated and a rectangular-solid-like shape having an opening portion 105 (refer to FIG. 5) in which the whole area is open on the side that faces the waste toner storing portion 103. In addition, the waste toner storing container 106 of the waste toner storing portion 103 is a box body of a cube-like shape having an opening portion 107 (refer to FIG. 5) in which the whole area is open on the side that faces the feed toner storing portion 102.

The feed toner storing container 104 and the waste toner storing container 106 may store a large amount of toner or waste toner in a limited attachment space by forming the cross section thereof to a rectangular shape, that is, a rectangular-solid-like shape or a cube-like shape, compared to the case of a cylindrical shape.

As shown in FIG. 5, the feed toner storing container 104 has a connection portion 108 at the end of the side where the opening portion 105 is located. The waste toner storing container 106 has a connection portion 109 fitting to the inner circumference of the connection portion 108 of the feed toner storing container 104 at the end of the side where the opening portion 107 is located.

The feed toner storing container 104 has a toner-feeding-side area 110 occupying the approximately two thirds portion of the side opposite to the opening portion 105 along the longitudinal direction. The toner-feeding-side area 110 has a side surface 110*a* formed in a circular arc shape.

The toner cartridge 13 has a driving portion 115 for moving the toner cartridge 13. In addition, a shutter 113 for opening and closing a toner feeding opening 111 is slidably attached to the toner feeding opening 111 along the horizontal direction. As shown in FIG. 5, a seal member 114 is adhered to the inside of the shutter 113.

Further, the feed toner storing container 104 and waste toner storing container 106 configuring the toner cartridge 13 are partitioned by a partition member 117 and seal members 118 and 119 as leak prevention members integrally disposed on the both sides, that is, the front side and the back side of the partition member 117.

A cylindrical bearing portion 117*a* is integrally disposed to the partition member 117. The bearing portion 117*a* is formed as a cylindrical bag structure having an opening portion 117*b*. The tip portion 141*a* of an agitator shaft 141 of an agitator 140 as a stirring conveying member is inserted into the bearing portion 117*a* from the opening portion 117*b*. The bearing portion 117*a* axially supports the tip portion 141*a* of the agitator shaft 141.

The cylindrical bearing portion 117*a* is formed so that the closed tip portion is extended to inside of the waste toner storing portion 103. Further, the tip portion is formed so that the tip portion is extended to the waste toner storing portion 103 more than the end of the connection portion 108 of the feed toner storing container 104.

Further, the bearing portion 117*a* of the partition member 117 also has a function as a gripper held by a robot hand of an automatic assembler (not shown in the figure) when the toner cartridge 13 is assembled by mounting the partition member 117 to the inside of the connection portion 108 of the feed toner storing container 104 by the automatic assembler and the like.

In addition, a seal L on which various instructions and the like are printed is attached on the exterior top surface in the upward direction in a state similar to a state where the feed toner storing container 104 is attached to the body 1 of the image forming apparatus (an attachment state).

The outer circumferences of the connection portions 108 and 109 are covered with a tape 122 in order to prevent the unexpected disengagement of the feed toner storing container 104 and the waste toner storing container 106. Further, the toner cartridge 13 may be easily disassembled and easily recycled by peeling off the tape 122.

On the waste toner storing container 106, the handle member 128 for attaching and fixing the toner cartridge 13 to a predetermined position is rotatably attached with a supporting point 129 (refer to FIG. 4) as the center.

As shown in FIG. 5, the agitator 140 is disposed inside of the feed toner storing portion 102 as a stirring conveying member which conveys a feed toner stored in the feed toner storing portion 102 while stirring the feed toner. The agitator 140 has the agitator shaft 141 as an axis portion rotatably supported and an agitator film 142 as a stirring conveying portion provided to the agitator shaft 141. Further, the rear end portion of the agitator shaft 141 is provided with a driving gear 156 for rotationally driving the agitator shaft 141.

Figure 6:
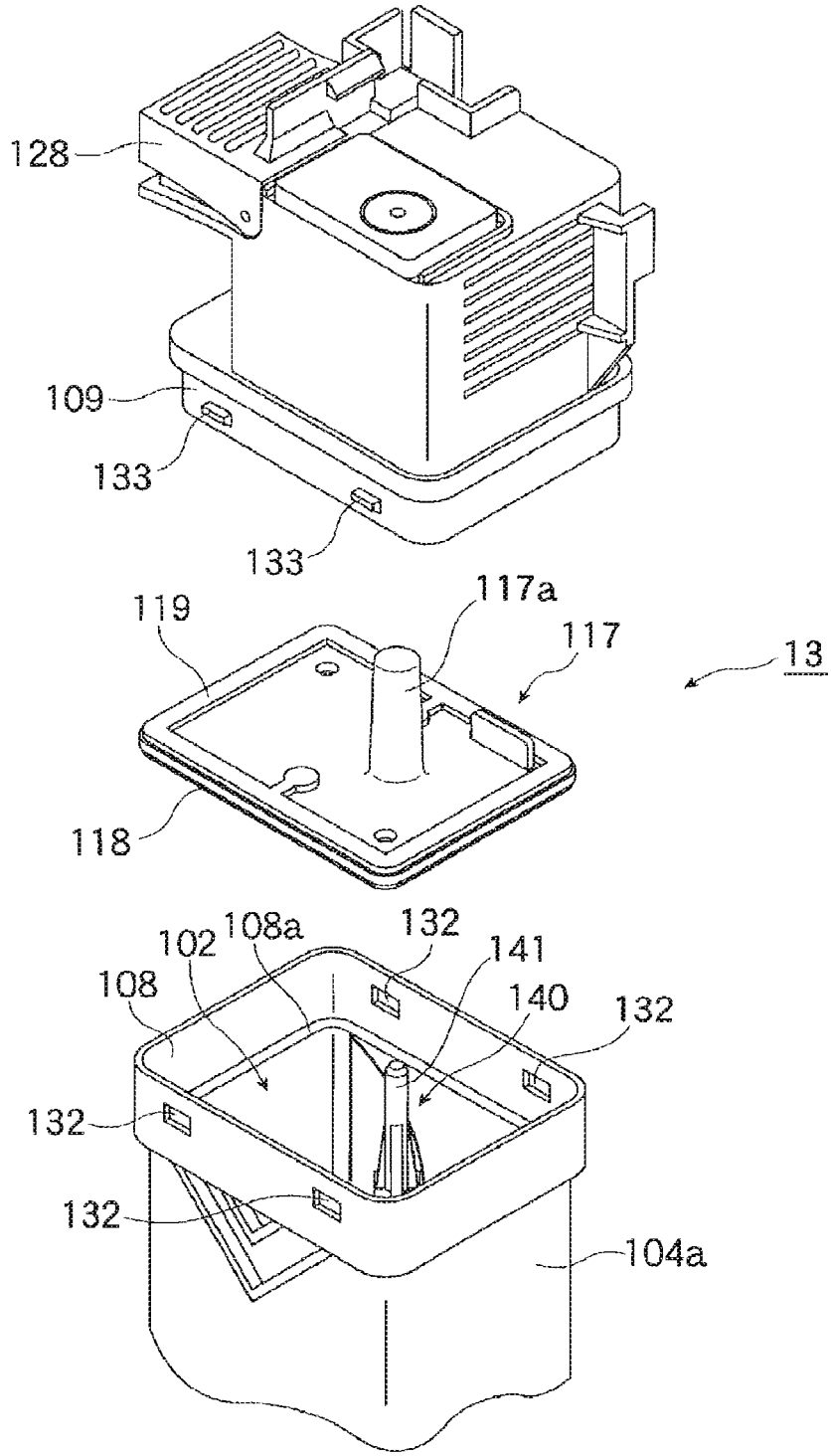
FIG. 6 is a perspective view showing the vicinity of the opening portion in a state where the toner cartridge is disassembled.

FIG. 6 is a perspective view showing the vicinity of the opening portion in a state where the toner cartridge 13 is disassembled. As shown in FIG. 6, in the opening portion, the connection portion 108 formed in a rectangular shape one size larger than a step portion 108*a* is configured through the step portion 108*a* in the periphery of a corner portion 104*a* of the feed toner storing portion 102. In addition, the connection portion 109 of the waste toner storing container 106 is formed so as to fit the inside of the connection portion 108 of the feed toner storing container 104 in a rectangular shape smaller than the connection portion 108 of the feed toner storing container 104. The inner circumference length of the connection portion 108 of the feed toner storing container 104 is approximately equal to the outer circumference length of the connection portion 109 of the waste toner storing container 106.

Two portions having a connection hole 132, each of which has a small rectangular shape and engages with the connection portion 109 of the waste toner storing container 106 to connect each other by a snap fit, are individually disposed at a predetermined interval on the side of the front surface and the back surface of the connection portion 108 of the feed toner storing container 104. Two protrusions 133, each of which has a small rectangular shape and is engaged with the corresponding portion having the connection hole 132 provided on the connection portion 108 of the feed toner storing container 104 to connect each other by a snap fit, are individually disposed corresponding to the portion having the connection hole 132 on the side of the front surface and the back surface of the connection portion 109 of the waste toner storing container 106.

Figure 7:
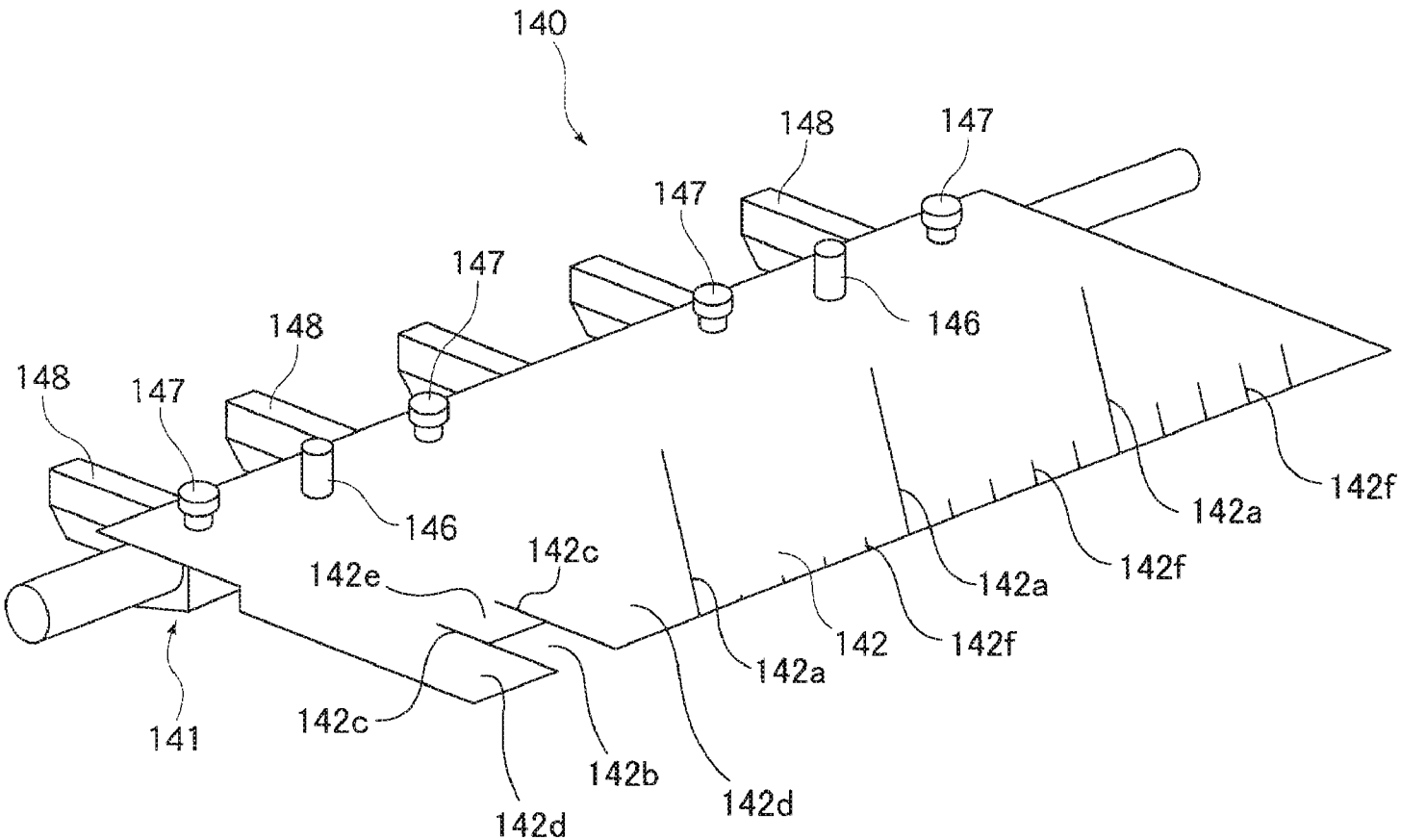
FIG. 7 is a perspective view showing the agitator functioning as a stirring conveying member.

FIG. 7 is a perspective view showing the agitator 140 functioning as a stirring conveying member. As mentioned above, the agitator 140 has the agitator shaft 141 as an axis portion of a rotation center and the agitator film 142 as a stirring conveying portion. In order to adjust the conveying amount of toner and the like, plural slits 142*a* having a predetermined slope angle, a concave portion 142*b* and cuts 142*c* are formed at the tip of the agitator film 142. In addition, the agitator film 142 has small slits 142*f* which Slave a smaller cut amount than plural slits 142*a* at nearly the same slope angle asp plural slits 142*a*.

A sliding portion 142*d* that slides the inner circumferential face of the toner-feeding-side area 110 (refer to FIGS. 9A to 9C) is formed by one slit 142*a* and one cut 142*c* when the agitator film 142 is rotated. In addition, between the two cuts 142*c*, a cutout portion (insertion portion) 142*e* is formed which is inserted into the toner feeding opening 111 to facilitate the discharge of toner when the agitator film 142 is rotated. In other words, the agitator 140 has the cutout portion 142*e* which may be inserted into the toner feeding opening 111 at the tip side of the agitator 140 (tip side of the agitator film 142) and the sliding portion 142*d* which is disposed adjacent to the both ends of the cutout portion 142*e*, has a length from the rotation center longer than the cutout portion 142*e* and slides the inner wall of the feed toner storing container 104 of the side portion of the toner feeding opening 111.

The agitator film 142 of the agitator 140 is formed by, for example, polyethylene terephthalate (PET) sheet and has flexibility to such a degree that the agitator film 142 is distorted by the pressure applied by the toner stored in the feed toner storing container 104. Further, the tip side away from the agitator shaft 141 which is the rotation center may slide a curvature portion 116 (refer to FIG. 9C) of the feed toner storing storing container 104.

In addition, the deflection amount of the agitator film 142 may be significantly different in each side of the slit 142*a*, thereby the a portion of the agitator film 142 may be in full sliding contact with the inner surface of the feed toner storing container 104.

The width of the cutout portion (the insertion portion) 142*e* specified by the two cuts 142*c* is smaller than the width in the axis direction (the longitudinal direction of the feed toner storing container 104) of the toner feeding opening 111 of the feed toner storing container 104. Further, the size of the concave portion 142*b* is determined depending on the length of the cutout portion 142*e* formed. The shape of the cutout portion 142*e* is determined by the two cuts 142*c*, the length of the two cuts 142*c* and the size of the concave portion 142*b*. Furthermore, the shape of the cutout portion 142*e* is determined depending on the function of the cutout portion 142*e* which is inserted into the toner feeding opening 111 and tipped up. In addition, the dimension by which the toner is favorably fed out is selected by the cutout portion 142*e*. Further, the length of the cutout portion 142*e* is a length such that the tip side away from the agitator shaft 141 as the rotation center may slide the curvature portion 116 of the feed toner storing container 104.

The agitator film 142 having such a shape is attached to the agitator shaft 141 in a state where the agitator film 142 is inserted into protrusions 146 and 147.

The agitator shaft 141 which is an axis portion has plural protrusions 148 protruding toward the outside from the rotation center in the longitudinal direction. Even if toner blocking occurs, the toner blocking may be relatively rapidly loosened by the plural protrusions 148. In addition, the toner blocking is loosened by using the conveying power of the agitator film 142 that conveys a toner in a longitudinal direction of the feed toner storing container 104.

Figure 8A:
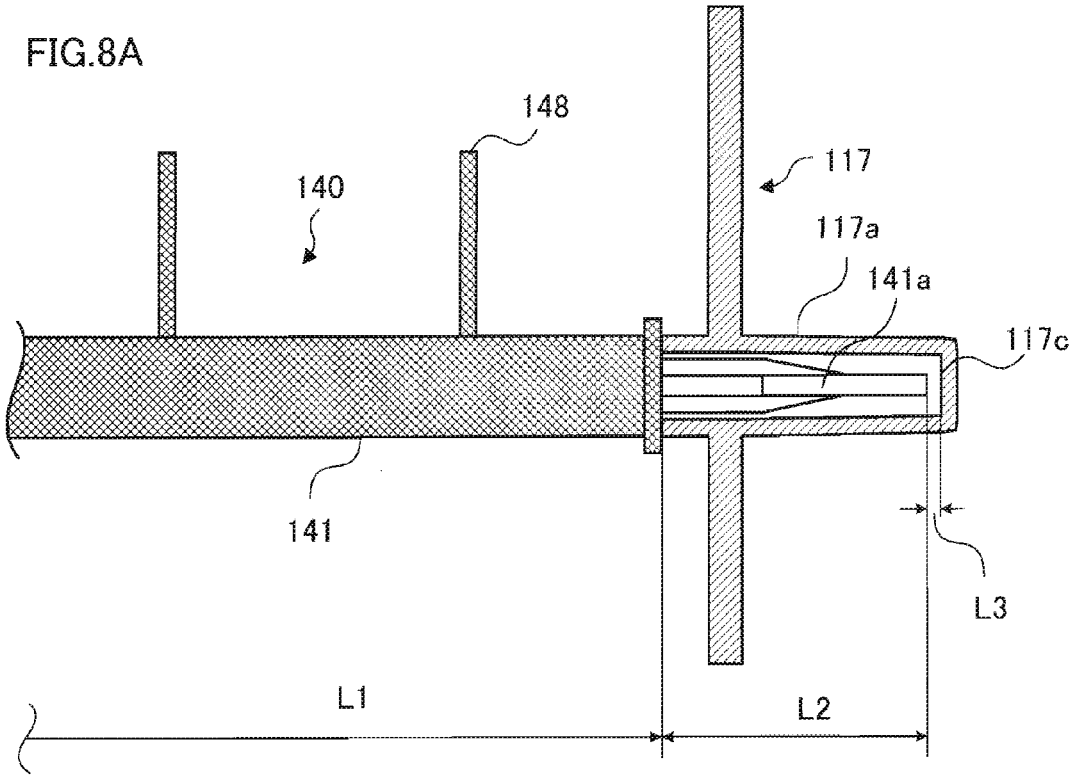
FIGS. 8A and 8B are sectional views explaining a state where the agitator is axially supported by the bearing portion of the partition member.
Figure 8B:
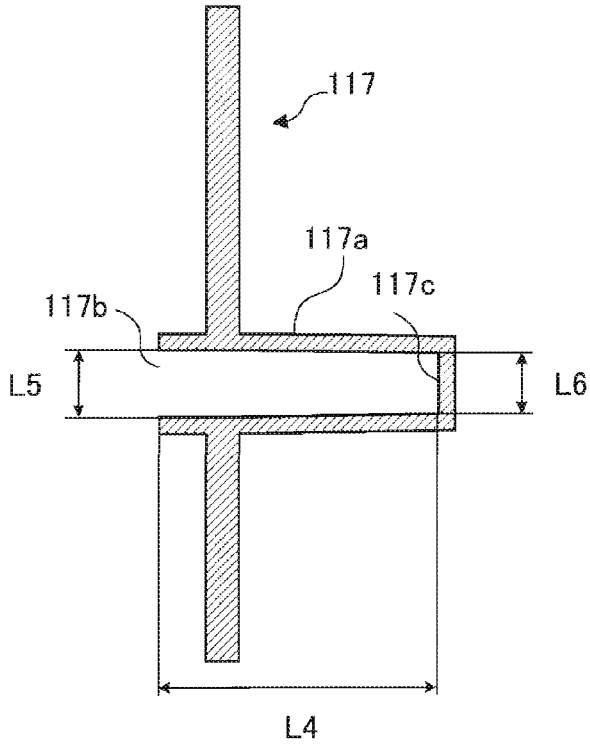

FIGS. 8A and 8B are sectional views explaining a state where the agitator 140 is axially supported by the bearing portion 117*a* of the partition member 117. FIG. 8A is a sectional view explaining a state where a tip portion 141*a* of the agitator shaft 141 is inserted into the bearing portion 117*a*. FIG. 8B is a sectional view of the partition member 117.

As shown in FIG. 8A, the tip portion of the cylindrical bearing portion 117*a* is formed so as to extend to the waste toner storing portion 103 (refer to FIG. 6. The agitator 140 functioning as a stirring conveying member is axially and rotatably supported by the bearing portion 117*a* by inserting the tip portion 141*a* of the agitator shaft 141 as a shaft portion through the opening portion 117*b* of the bearing portion 117*a*. Further, as shown in FIG. 8A, the agitator shaft 141 has the plural protrusion portions 148 protruding from the rotation center toward outside along a longitudinal direction.

Here, L1 is a length of the agitator shaft 141 in the feed toner storing container 104. L2 is a length of the tip portion 141*a* housed in the bearing portion 117*a*. In addition, L3 is a clearance between the tip end of the Lip portion 141*a* housed in the bearing portion 117*a* and a bottom portion 117*c* of the bearing portion 117*a*.

In the present exemplary embodiment, the ratio (L2/L1) of the length L2 of the tip portion 141*a* housed in the bearing portion 117*a* to the length L1 of the agitator shaft 141 in the feed toner storing container 104 is about 0.1 or more and preferably about 0.2 or more.

In addition, in the present exemplary embodiment, L3 is about 0.1 to about 1.0 mm.

Further, as shown in FIG. 8B, in the present exemplary embodiment, in the partition member 117, the length L4 from the bearing opening portion 117*b* of the bearing portion 117*a* to the bottom portion 11-7*c* is, for example, 20.5 mm. The inner diameter L5 of the bearing opening portion 117*b* is, for example, 5 mm. The inner diameter L6 of the bottom portion 117*c* of the bearing portion 117*a* is, for example, 4 mm.

In the present exemplary embodiment, the maximum outer diameter of the tip portion 141*a* of the agitator shaft 141 inserted into the bearing portion 117*a* is prepared to be small as appropriate so that the clearance around the bearing opening portion 117*b* is about 0.05 mm to about 0.2 mm.

In this way, in the present exemplary embodiment, the cylindrical bearing portion 117*a* which axially supports the tip portion 141*a* of the agitator shaft 141 of the agitator 140 as a stirring conveying member is integrally disposed on the partition member 117 which connects the feed toner storing container 104 with the waste toner storing container 106. Further, the tip portion of the bearing portion 117*a* is formed so as to extend to the waste toner storing container 106 more than the edge portion of the connection portion 108 of the feed toner storing container 104.

The toner stored in the feed toner storing container 104 may be prevented from leakage to the waste toner storing container 106 by forming the cylindrical bearing portion 117*a* axially supporting the tip portion 141*a* in a cylindrical bag structure.

In addition, the tip portion 141*a* is supported by the cylindrical bag structure by extending the cylindrical bearing portion 117*a* to the outside of the feed toner storing container 104 by approximately 20 mm. By so doing, even if force perpendicular to the axis direction of the agitator shaft 141 is applied, the toner in the feed toner storing container 104 is stably conveyed and the remaining toner amount may be reduced to the fullest extent without deforming the axis of the agitator shaft 141.

Next, the structure of the feed toner storing container 104 of the toner cartridge 13 will be explained.

Figure 9A:
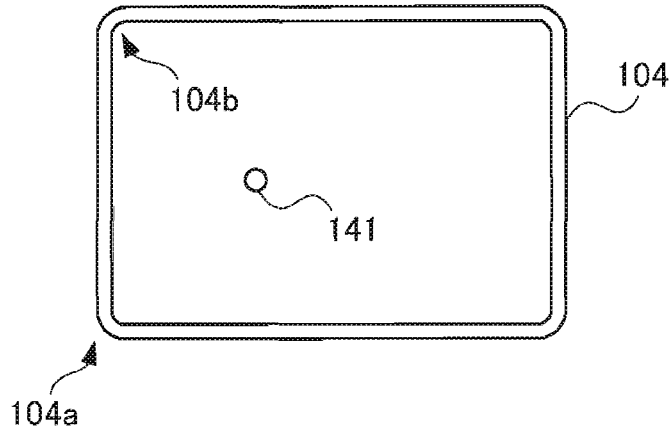
FIGS. 9A to 9C are sectional views of plural places in a direction perpendicular to the longitudinal direction of the feed toner storing container and show states where each cross-section is viewed from the side of the opening portion.
Figure 9B:
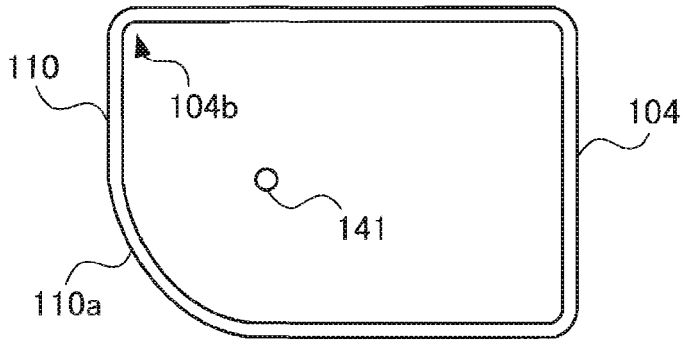
Figure 9C:
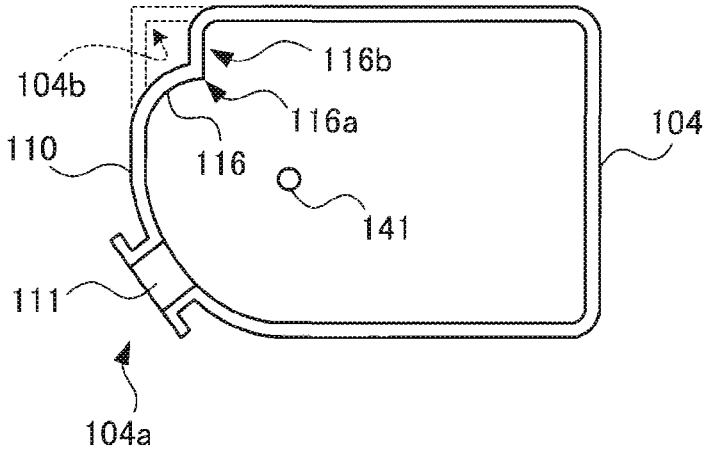

FIGS. 9A to 9C are sectional views of plural places in a direction perpendicular to the longitudinal direction of the feed toner storing container 104 and show states where each cross-section is viewed from the side where the opening portion 105 is located. The up-and-down directions of the states shown in FIGS. 9A to 9C correspond to the up-and-down directions in the same position when the toner cartridge 13 is attached to the image forming apparatus.

FIG. 9A is a sectional view of the area occupying the approximately one-third of the side where the opening portion 105 is located in the longitudinal direction of the feed toner storing container 104. FIG. 9B is a sectional view of a portion relatively near to the side where the opening portion 105 is located in the toner-feeding-side area 110 occupying the approximately two-thirds portion of the opposite side where the opening portion 105 is located along the longitudinal direction of the feed toner storing container 104. FIG. 9C is a sectional view of the area including the toner feeding opening 111.

As shown in, FIGS. 9A to 9C, the feed toner storing container 104 has a shape of R or the like at an angular portion (a corner portion), but forms a cross section of a rectangular shape (a nearly rectangular shape) as a whole and has an angular portion 104*a* at the lower left (one side portion of the bottom surface in FIG. 9A and the side where the body 1 of the image forming apparatus in the attachment state) located in the same position when attached to the image forming apparatus and a corner portion 104*b* above the angular portion 104*a* inside of the feed toner storing container 104.

As shown in FIG. 9B, the angular portion 104*a* shown in FIG. 9A forms a side surface 110*a* of a circular arc shape in the toner-feeding-side area 110. Further, as shown in FIG. 9C, the feed toner storing container 104 has the toner feeding opening 111 which supplies toner to the developing device 11 (refer to FIG. 1) in the end portion in a direction along the longitudinal direction of the side surface 110*a* of a circular arc shape formed.

As shown in FIG. 9C, the curvature portion 116 is formed in the corner portion 104*b* located above the toner feeding opening 111. In addition, as shown in FIG. 9C, the curvature portion 116 has a step 116*b* raising upward from a changing point 116*a*. The step 116*b* expands the toner holding volume of the feed toner storing portion 102 and is configured so as to increase the toner holding capacity even in the case of a compact toner cartridge 13.

In general, in the corner (each corner portion) of the rectangular area, the so-called toner blocking tends to occur in which the toners are agglomerated with each other into a blocked state and this toner blocking is caused by the change of toner with time, for example, toner surface melting. For example, even if the toner cartridge 13 is stored upside down or sideways, the toner blocking right above the toner feeding opening 111 may be prevented from occurring by replacing the corner portion 104*b* above the toner feeding opening 111 with the curvature portion 116. Further, if the toner blocking occurs above the toner feeding opening 111, the toner blocking may be easily transferred to a direction away from the side when the toner feeding opening 111 is located at the beginning of the rotation of the stirring conveying member (the agitator 140).

FIGS. 10A to 10D are figures for explaining a rotation state of a stirring conveying member in the feed toner storing container 104. The agitator 140 functioning as a stirring conveying member rotates in the arrow direction of the figures with the center of the tip portion 141*a* of the agitator shaft 141 as the rotation center. By this rotation, the blade portion (tip) of the agitator film 142 is brought into contact with the inner surface of the feed toner storing portion 102 (feed toner storing container 104) while deflecting. At this time, the agitator film 142 is rotatably driven in a state where the agitator film 142 is spirally deformed because the agitator film 142 has slits 142*a*. The agitator 140 stirs the feed toner stored in the feed toner storing portion 102 by the rotational driving, transfers the toner towards the toner feeding opening 111 disposed at the one side of the angular portion (corner portion) of the feed toner storing portion 102 and gradually supplies the toner in the one side towards each of the developing devices 11 (11Y, 11M, 11C and 11B) from each of the toner cartridges 13Y, 13M, 13C and 13B.

Figure 10A:
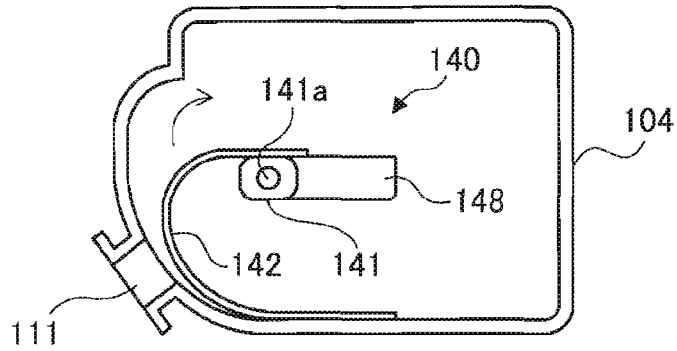
FIGS. 10A to 10D are figures for explaining a rotation state of a stirring conveying member in the feed toner storing container.
Figure 10B:
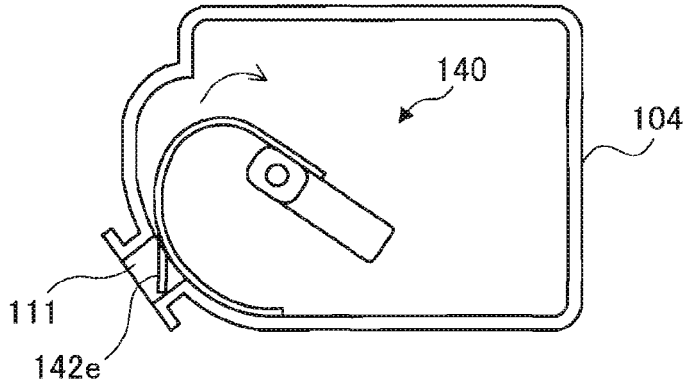

For example, when the state shown in FIG. 10A is transferred to the state shown in FIG. 10B, as shown in FIG. 10B the cutout portion 142*e* having a length shorter than the length of other blades is tipped up to the toner feeding opening 111 in the agitator film 142. Thereby, the toner conveyed in the feed toner storing container 104 may be suitably fed out from the toner feeding opening 111.

Figure 10C:
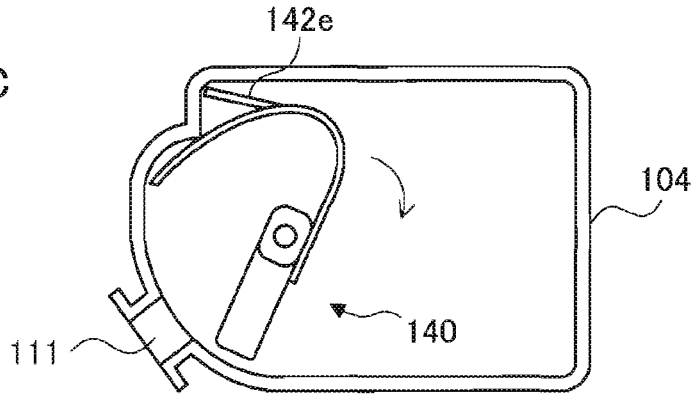

Further, when the state shown in FIG. 10B is transferred to the state shown in FIG. 10C, among the blade portions of the agitator film 142 which are in contact with the curvature portion 116, the cutout portion 142*e* having the shorter length is tipped up by the presence of the step 116*b* at the changing point 116*a* (refer to FIG. 10C). The tipping up of the cutout portion 142*e* is effective for loosening the agglomerated toner (toner blocking).

Figure 10D:
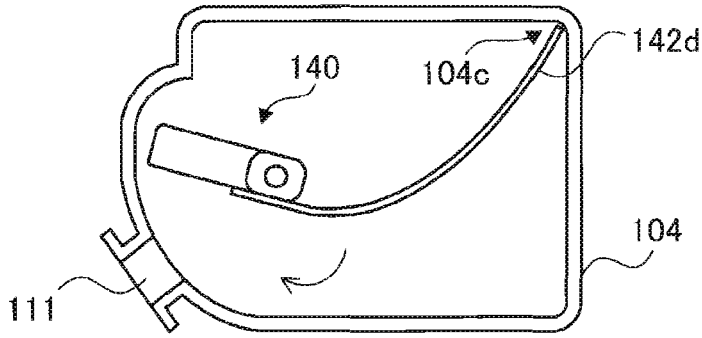

Furthermore, as shown in FIG. 7, the sliding portion 142*d* disposed adjacent to the cutout portion (insertion portion) 142*e* at the blade portion of the agitator film 142 has a longer length from the rotation center than the cutout portion (insertion portion) 142*e*. The sliding portion 142*d* slides the inner wall of the feed toner storing container 104 which is the most distant from the agitator shaft 141. For example, as shown in FIG. 10D, the tip of the sliding portion 142*d* may slide a corner portion 104*c* of the feed toner storing container 104.

(Toner)

Next, a toner used in the present exemplary embodiment will be explained.

The toner used in the present exemplary embodiment includes an binder resin and a coloring agent as a main component. Further, various external additives are used where necessary.

(Binder Resin)

The binder resin includes a thermoplastic resin comprising a homopolymer and copolymer of various polymerizable monomers.

Such a polymerizable monomer includes, for example, styrenes such as styrene and chlorostyrene; a monoolefin such as ethylene, propylene, butylene and isobutylene; a vinyl ester such as vinyl acetate, vinyl propionate, vinyl benzoate and vinyl butyrate; an α-methylene aliphatic monocarboxylic acid ester such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; a vinyl ether such as vinyl methyl ether, vinyl ethyl ether and vinyl butyl ether; and a vinyl ketone such as vinyl methyl ketone, vinyl hexyl ketone and vinyl isopropenyl ketone.

A representative binder resin includes, for example, polystyrene, styrene-alkyl acrylate copolymer, styrene-alkyl methacrylate copolymer, styrene-acrylonitrile copolymer, styrene-butadiene copolymer, styrene-maleic acid anhydride copolymer, polyethylene and polypropylene.

Further, there may be mentioned polyester, polyurethane, epoxy resin, silicone resin, polyamide, modified rosin, and paraffin wax.

(Coloring Agent)

As the representative coloring agent, there may be exemplified, for example, carbon black, aniline blue, carcoil blue, chrome yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I pigment red 81:1, C.I. pigment yellow 97, C.I. pigment yellow 12, C.I. pigment yellow 17, C.I. pigment blue 15:1, C.I. pigment blue 15:3 and the like.

The toner used in the present exemplary embodiment has a volume average particle diameter of typically 10 μm or less. If the volume average particle diameter is excessively large, the image quality is deteriorated and the granularity of toner particularly tends to decrease.

(External Additive)

The external additive used in the present exemplary embodiment typically includes inorganic oxide fine particles, a charge control agent, a release agent (waxes), a cleaning agent and the like.

The inorganic oxide fine particles include, for example; $SiO_2$, $TiO_2$, $Al_2O_3$, $Fe_2O_3$, MnO, ZnO, MgO, CaO, $K_2O$, $Na_2O$, $SnO_2$, $ZrO_2$, $CaCO.SnO_2$, $K_2.(TiO_2)_n$ and the like. Among these, $TiO_2$ and $SiO_2$ are preferable. The particle diameter of the inorganic oxide fine particle is typically 3 nm to 1 μm and preferably 5 nm to 100 nm.

These inorganic oxide fine particles may be used alone or in combination with other inorganic oxide fine particles and the like. In additions organic fine particles may be used at the same time.

The charge control agent includes for example, metal salt of benzoic acid, metal salt of salicylic acid, metal salt of alkylsalicylic acid, metal salt of catechol, metal-containing bisazo dye, tetraphenylborate derivative, quarternary ammonium salt, alkylpyridinium salt, nigrosine-based compound, a dye comprising a complex of aluminum, iron, chromium and the like, fluorine-based surfactant, polymer acid such as maleic acid copolymer, triphenylmethane pigment, polar group-containing resin type charge control agent and the like. In addition, those accordingly combined with the above-mentioned materials may be preferably used.

As the release agent, a conventionally known one may be used without any particular limitation. As the specific examples of natural waxes, there may be mentioned, for example, a vegetable based wax such as carnauba wax, cotton wax, haze wax and rice wax; an animal based wax such as bees wax and lanolin; a mineral based wax such as ozokerite and ceresin; a petroleum wax such as paraffin, microcrystalline wax and petrolactum; and the like.

The synthetic waxes include a synthetic hydrocarbon wax such as Fischer-Tropsch wax and polyethylene wax; a fatty acid amide such as 12-hydroxystearic acid amide, stearic acid amide, anhydrous phthalic acid amide and chlorinated hydrocarbon; a low molecular weight olefin such as low molecular weight polypropylene and low molecular weight polyethylene; and the like.

Further, the crystalline polymeric resin having a low molecular weight Includes a homopolymer of acrylate such as poly(n-stearylmethacrylate) and poly(n-laurylmethacrylate) or a copolymer thereof and a crystalline polymer having a long-chain alkyl group as a side chain. Among these, preferable are paraffin wax and ether wax.

The cleaning agent includes, for example, an inorganic fine powder such as silica; an organic fine powder such as fatty acid or its derivative and metal salt; a fluorine-based resin fine powder; and the like.

(Shape Factor SF1 of Toner)

The toner used in the present exemplary embodiment has the average value of the share factor SF1 defined by the following Equation (1) in the range of about 130 or less, preferably about 100 to about 130 and more preferably about 110 to about 130.

$$SF1=100\times(\pi/4)\times(ML^2/S) \quad (1)$$

In the Equation (1), ML represents the absolute maximum length of a toner particle. S represents the projected area of a toner particle. In case of the particle which is completely spherical, the shape factor SF1 is 100. The greater the strain is, the larger the shape factor value is. The absolute maximum length of a toner particle and the projected area of a toner particle are quantified by mainly analyzing an optical microscope image or a scanning electron microscope image using an image analysis apparatus.

In the present exemplary embodiment, the conveying property of the toner in the feed toner storing container 104 is secured and the intrusion of toner into the bearing portion 117*a* is prevented in a state where the tip portion 141*a* of the agitator shaft 141 is inserted into the bearing portion 117*a* having a cylindrical bag structure by using the toner having a shape factor SF1 defined by the Equation (1) of about 130 or less. For this reason, the agglomeration of the toner, the fusion of the toner intruded into the bearing portion 117*a* and the like are unlikely to occur.

If the shape factor SF1 of toner is excessively large, the fluidity of the toner in the feed toner storing container 104 is increased, thereby tending to increase the intrusion of the toner into the bearing portion 117*a*.

The intrusion of the toner into the bearing portion 117*a* is prevented when the toner used in the present exemplary embodiment has a shape factor SF1 defined by the Equation (1) of about 130 or less. The reason is not clear, but it is considered as follows.

That is, the toner stored In the feed toner storing container 104 is stirred by the agitator 140 as a stirring conveying member and then the toner particles are slidably contacted with each other. For this reason, if the shape of the toner particle is nearly spherical (the shape factor SF1 is about 100 to about 130) the embedding of an external additive on a surface of the toner particle occurs in a short period of time and then surfaces of the toner particles are contacted with each other. Thus, it is considered that the toner particles are prevented from sliding with each other and are prevented from entering the gap between the tip portion 141*a* of the agitator shaft 141, and the bearing portion 117*a*.

On the contrary, when the toner particle has an indefinite shape and many concave portions or the like (the shape factor SF1 is more than about 130), the toner particles are point-contacted with each other because of the difficulty in the embedding of the external additive into the concave portion and the high curvature of a convex portion. For this reason, it is considered that the toner particles easily slide with each other and the toner easily enters the gap in the bearing portion 117*a* even if the stirring in the feed toner storing container 104 is continued. If the toner enters the gap in the bearing portion 117*a* and then agglomerates and fuses in the bearing portion 117*a*, the stirring effect of the toner by the agitator 140 is decreased, and if agglomerated or fused toner is conveyed to the developing device 11, an image defect is likely to occur.

As a method for controlling the shape factor SF1 of the toner used in the present exemplary embodiment to about 130 or less, a conventionally known method may be adopted without any particular limitation. For example, there may be mentioned a method in which toner is produced by a polymerization method to ensphere the toner (Japanese Patent Laid-Open Publication No. SHO 61-18965 and Japanese Patent Laid-Open Publication No. SHO 61-19602); a method in which a resin containing a toner blending component and a medium are mixed and stirred at the softening point of the resin and medium and then the medium is removed (Japanese Patent Laid-Open Publication No. SHO 60-57350); a method in which a resin containing a toner blending component is atomized in a molten state and cooled to ensphere the resin (Japanese Patent Laid-Open Publication No. SHO 54-80752); a method in which the particles obtained through each process of kneading, pulverization and classification are redispersed in a solvent and the surface of the particle powder is melted by a not air using a spray dryer to ensphere the powder (Japanese Patent Laid-Open Publication No. SHO 56-51958 and Japanese Patent Laid-open Publication No. SHO 59-127662); a method of pulverizing and simultaneously ensphering a particle powder obtained by kneading and roughly pulverizing by adjusting the temperature of the inlet air (Japanese Patent Laid-Open Publication No. SHO 61-61627); a method in which a particle powder obtained through each process of kneading, pulverization and classification is dispersed in a hot air flow and the surface is melted to ensphere the powder (Japanese Patent Laid-Open Publication No. SHO 58-134650, Japanese Patent Laid-Open Publication No. SHO 59-127640, Japanese Patent Laid-Open Publication No. SHO 61-249710 and Japanese Patent Laid-Open Publication No. HEI 3-179363); a method in which a mechanical impact force is applied to a particle powder obtained thorough each process of kneading, pulverization and classification in a gas-solid two-phase flow to smoothen the surface and ensphere the powder (Japanese Patent Laid-Open Publication No. SHO 63-235957, Japanese Patent Laid-Open Publication No. SHO 63-249155 and Japanese Patent Laid-Open Publication No. HEI 2-167566) and the like.

(Production of Toner)

The toner used in the present exemplary embodiment may be produced by a conventionally known production method. The production method is not particularly limited and may be determined accordingly depending on the objective. For example, there may be mentioned a kneading and pulverizing method, a kneading and freezing pulverization method, a drying-in-liquid method, a method of shearing and stirring a molten toner in an insoluble liquid to be pulverized, a method of dispersing an binder resin and a colorant in a solvent to be pulverized the resulting mixture by jet spray, an emulsion and aggregation method using a resin produced by an emulsion polymerization method, a suspension polymerization method, a solubilized suspension method and the like.

Specifically, there may be mentioned, for examples a method in which a resin, a release agent, colorant and charge control agent and the like are homogeneously dispersed using a pressure kneader and the likes the mixture is collided against a target mechanically or in a jet stream to be pulverized to a desired toner particle size, the toner particles are optionally smoothened and ensphered and further followed by classification to obtain toner having a sharp particle size distribution; a method of atomizing a molten mixture into the air using a disk or a multi-fluid nozzle to obtain a spherical toner (Japanese Published Patent Application. No. SHO 56-13945; a method of directly producing toner by the use of a suspension polymerization method (Japanese Published Patent Application No. SHO 36-10231, Japanese Patent Laid-Open Publication No. SHO 59-53856 and Japanese Patent Laid-Open Publication No. SHO 59-61842); a dispersion polymerization method of directly producing toner using an aqueous organic solvent in which the monomer is soluble but the resultant polymer is insoluble; and an emulsion polymerization method typified by a soap-free polymerization method of producing toner through direct polymerization in the presence of a water soluble polar polymerization initiator.

Further, there may be mentioned a method in which a resin particle dispersion liquid, a colorant particle dispersion liquid and a release agent particle dispersion liquid are mixed and then these particles are agglomerated to heat and fuse the agglomerate particles (Japanese Patent No. 3246394); a method in which an binder resin and a colorant containing a polymer dispersing agent having a specific acid value and amine value are dissolved or dispersed in an organic solvent to prepare an oil phase component and the oil phase component is dispersed in an aqueous medium to granulate (Japanese Patent No. 3661422); a method in which a polymerizable mixture containing styrene and α-methylene aliphatic monocarboxylic acid esters as an binder resin is suspension polymerized to produce a polar polymer and the polar polymer is unevenly distributed on the surface of the toner particles (Japanese Patent Application Publication No. HEI 07-034126); a method of ensphering the raw material toner particles after being finely pulverized by the neat treatment in which hot air is blown (Japanese Patent Laid-Open Publication No. HEI 5-281783); and a method of using the vapor of solvent that swells the binder resin at the time when the pulverized toner is heated above the softening point of the binder resin in a hot air flow (Japanese Patent Laid-Open Publication No. HEI 9-34175). Among these, preferable are a method of ensphering mechanically or thermally toner prepared by a conventional pulverizing method, a suspension polymerization method, a solubilized suspension method, an emulsion aggregation method and the like.

(Carrier)

In the present exemplary embodiment, a two-component-type developer may be prepared by combining the above-mentioned toner and a given carrier.

The carrier includes a conventionally known carrier without any particular limitation, for example, a resin-coated carrier and the like (Japanese Patent Laid-Open Publication No. SHO 62-39879, Japanese Patent Laid-Open Publication No. SHO 56-11461 and the like). In addition, the mixing ratio of the toner to the carrier may be selected accordingly depending on the objective without any particular limitation.

The specific examples of the toner include, for example, preferably a coated carrier in which magnetic particles such as ferrite, magnetite or iron powder are coated with a coating material. The average particle diameter of the carrier is typically required to be 20 to 100 μm. If the average particle diameter of the carrier is excessively large, the peeling of the coated layer occurs due to the stress in the developing device, thus tending to decrease the carrier resistance. If the average particle size of the carrier is excessively small, a trouble called BCO (beads carry over) in which the carrier is transferred on a copy paper is likely to occur occurs and the toner impaction occurs, thereby tending to increase the developer resistance.

In addition, the magnetic particles comprising the carrier have a saturation magnetization in an applied magnetic field of 3000 ersted of 50 emu/g or more and preferably 60 emu/g or more. If the saturation magnetization is excessively low, the carrier tends to be developed on the photosensitive material together with the toner.

As the coating resin coating the magnetic particles, there are used a charge imparting resin for imparting charging property to the toner and a low surface energy material for preventing the toner components from being transferred to the carrier. An electroconductive powder may be used to control the resistance of the coated resin layer.

The charge imparting resin for imparting negative charge to the toner includes for example, amino resin urea-formaldehyde resin melamine resin, benzoguanamine resin, urea resin, polyamide resin, epoxy resin, acrylic resin, polymethyl methacrylate resin, polyvinyl acetate resin, polyvinyl alcohol resin, polyvinyl butyral resin, ethylcellulose resin and the like.

The charge imparting resin for imparting positive charge to the toner includes, for example, a polymer of a monomer having hydroxyl groups, carboxyl groups, sulfonic acid groups or phosphoric acid groups such as polyvinylchloride resin, polyvinylidenechloride resin, polyethylene terephthalate resin, polybutylene terephthalate resin, polycarbonate resin, polyacrylonitrile resin, fluorine-based resin and a polymer of a monomer having acid anhydride such as anhydrous maleic acid.

As the low surface energy material for preventing the toner components from being transferred to the carrier, there may be used, for example, polyethylene resin, polyvinyl fluoride resin, polyvinylidene fluoride resin, polytetrafluoroethylene resin, polyhexafluoropropylene resin, a copolymer of vinylidene fluoride and an acrylic monomer, a copolymer of vinylidene fluoride and vinyl fluoride, a terpolymer of tetrafluoroethylene, vinylidene fluoride and a non-fluorine monomer, a silicone resin and the like.

The electroconductive powder includes a metallic powder, carbon black, titanium oxide, tin oxide, zinc oxide and the like. These electroconductive powders preferably have an average particle diameter of 1 μm or less. If the average particle diameter thereof is excessively large, the electric resistance tends to be difficult to control.

As the structure of the coated layer, the above-described two kinds of resins may be dissolved with each other and in the case where they are riot dissolved with each other, the structure may be a phase separation structure. In addition, the charge imparting resin may be dispersed in a fine particle state in the low surface energy material.

The method of forming the above-mentioned coating layer on the magnetic particles includes, for example, a method of using a raw material solution for forming a coating layer (a charge imparting resin, a low surface energy material, electroconductive powders and the like are contained in a solvent). The specific examples include a spray dry method in which a raw material solution for forming a coating layer is sprayed on the surface of magnetic particles followed by the removal of a solvent; a kneader coater method in which magnetic particles and a raw material solution for forming a coating layer are mixed in a kneader coater followed by the removal of a solvent; and the like.

In the present exemplary embodiment, the above-mentioned carrier may be used as a developer in combination with any toner and is preferably used particularly in a full colordeveloper.

In addition, the coverage of the toner to the carrier is typically 20 to 70%. If the coverage is excessively small, the resistance of the developer is reduced, thereby tending to cause the development of the carrier itself or a so-called brush mark in which brush streaks of the developer are produced on the image. If the coverage is excessively large, the resistance of the developer is increased, thereby causing the image quality defect, for example, the deterioration of developing property at the low voltage site.

In the present exemplary embodiment, when toner and a given carrier are combined to be used as a two-component-type developer, it is preferable that an appropriate amount of carrier is added together with the toner in advance to the toner cartridge 13 and a fixed amount of carrier is supplied together with the toner to the developing device 11 due to the consumption of the toner and, meanwhile, the excessive developer is reclaimed to always maintain the constant charge level of the developer.

In general, in the case of the two-component-type developer, the toner is always consumed and newly replenished, however, the carrier remains in the developing device 11 and is easily subjected to the contamination with the toner components and completes its life eventually. The life span mainly depends on the toner consumption amount, and the larger the toner consumption amount is, the shorter the life span is. For this reason, in order to elongate the life span, the supply ratio of the carrier is adjusted depending on the toner assumption amount.

EXAMPLES

Hereinafter, the present invention will be more specifically explained based on examples and comparative examples. Moreover, the present invention is in no way limited to the following examples so long as the scope of the present invention is not exceeded.

In the present examples, various kinds of dispersion liquid and toner are prepared as described below. The physical properties of various resin fine particles and various kinds of toner are measured by the following methods.

(1) Measurement of Molecular Weight

The molecular weight of the resin fine particle and toner are measured by using gel permeation chromatography (GPC) (HLC-8120GPC, SC-8020, manufactured by Tosoh Corp.) and is determined as a value converted into standard polystyrene.

(2) Measurement of Glass Transition Temperature

The glass transition temperature of the resin fine particle and toner are measured by using a differential scanning calorimeter (DSC-50, manufactured by Shimadzu Corp.) at a temperature rising rake of 10 degrees C./min.

(3) Measurement of Particle Diameter of Dispersion Fine Particle

The particle diameter of the resin dispersion fine particles, colorant dispersion fine particles and release agent dispersion fine particles each is measured by using a laser diffraction particle size distribution analyzer (LA-700, manufactured by Horiba Ltd.). From the resulting particle size distribution, a volume average particle diameter and a small particle diameter side volume granule size distribution index GSDv-under are determined.

(4) Measurement of Shape Factor of Toner

On optical microscopic image of toner particles sprayed on a slide glass is taken in an image analysis apparatus (LUZEX III: manufactured by NIRECO Corp.) using a video camera to measure the diameter equivalent to a circle, and the shape factor SF1 is calculated based on the maximum length (ML) and the projected area (A) measured for 50 toner particles using the equation (1), and the number average is determined as an average value of the shape factor SF1.

(5) Preparation of Toner (Toner 1 to Toner 7)

(5-1 Toner 1)

As explained below, toner is prepared by using the two kinds of resin dispersion liquids (the resin dispersion liquid 1 and the resin dispersion liquid 2), the colorant dispersion liquid and the release agent dispersion liquid which are prepared in advance. The resulting toner has a shape factor SF1 of 120 (toner 1).

(Resin Dispersion Liquid 1)

A solution is prepared by mixing and dissolving 372 grams of styrene, 28 grams of n-butylacrylate, 6 grams of acrylic acids 23 grams of dodecanethiol and 4 grams of carbon tetrabromide. The solution is dispersed and emulsified in 550 grams of ion exchange water containing 5 grams of a surfactant (a nonionic surfactant, Nonipol 400, produced by Sanyo Chemical Industries, Ltd.) and 10 grams of an anionic surfactant (Neogen SC, produced by Dai-ichi Kogyo Seiyaku Co. Ltd.) in a flask, and awhile mixing the liquid for 10 minutes, 50 grams of ion exchange water in which 4 grams of ammonium persulfate is dissolved is added to the flask and then the air in the flask is replaced with nitrogen.

Next, while stirring the contents in the flask, emulsion polymerization is continued at 70 degrees C. for 5.5 hours to obtain an anionic resin dispersion liquid (a resin dispersion liquid 1) having a center particle diameter of 160 nm, a glass transition temperature of 60 degrees C. and a weight average molecular weight (Mw) of 12,300.

(Resin Dispersion Liquid 2)

A solution is prepared by mixing and dissolving 278 grams of styrene, 122 grams of n-butylacrylate and 8 grams of acrylic acid. The solution is dispersed and emulsified in 550 grams of ion exchange water containing 5 grams of a surfactant (a nonionic surfactant, Nonipol 4500 produced by Sanyo Chemical Industries, Ltd.) and 12 grams of an anionic surfactant (Neogen SC, produced by Dai-ichi Kogyo Seiyaku Co. Ltd.) in a flasks and while mixing the liquid for 10 minutes, 50 grams of ion exchange water in which 3 grams of ammonium persulfate is dissolved is added to the flask and then the air in the flask is replaced with nitrogen.

Next, while stirring the contents in the flask, emulsion polymerization is continued at 70 degrees C. for 5.5 hours to obtain an anionic resin dispersion liquid (a resin dispersion liquid 2) having a center particle diameter of 102 nm, a glass transition temperature of 52 degrees C. and a weight average molecular weight (Mw) of 555,000.

(Colorant Dispersion Liquid)

A colorant dispersion liquid is obtained by mixing 20 grams of a copper phthalocyanine pigment (PVFASTBLUE, produced by BASF AG), 2 grams of an anionic surfactant (Neogen SC, produced by Dai-ichi Kogyo Seiyaku Co. Ltd.) and 78 grams of ion exchange water and then is dispersed at an oscillating frequency of 28 kHz for 10 minutes using an ultrasonic cleaner (W-113, manufactured by Honda Electronics Co., Ltd.) to obtain a colorant dispersion liquid. The colorant dispersion liquid has a volume average particle diameter of 155 nm and no large particles having a particle size of 1 μm or more are observed.

(Release Agent Dispersion Liquid)

A release agent dispersion liquid is prepared by heating 200 grams of paraffin wax (HNP 0190 having a melting point of 85 degrees C., produced by Nippon Seiro Co.; Ltd.), 10 grams of an anionic surfactant (Neogen SC, produced by Dai-ichi Kogyo Seiyaku Co. Ltd.) and 790 grams of ion exchange water to 95 degrees C. and then is emulsified at a discharge pressure of $560\times10^5$ N/m$^2$ using a Gaulin homogenizer, followed by rapid cooling to obtain a release agent dispersion liquid. The release agent dispersion liquid has a volume average particle diameter of 155 nm and large particles having a particle size of 0.8 μm or more are 5% or less.

A mixture of 180 grams of the above mentioned resin dispersion liquid 1, 80 grams of the resin dispersion liquid 2, 30 grams of the colorant dispersion liquid, 130 grams of the release agent dispersion liquid and 1.5 grams of an cationic surfactant (Sanisol B-50, produced by Kao Corp.) are mixed and dispersed in a round bottom stainless steel flask by using homogenizer (Ultra-Turrax T50, manufactured by IKA Co., Ltd.)), and then the flask is heated up to 50 degrees C. on a heating oil bath while stirring. After the temperature of the flask is maintained at 50 degrees C. for one hour, it is confirmed by observation under optical microscope that agglomerated particles having a particle size of approximately 6 μm are generated.

Thereafter, 3 grams of an anionic surfactant (Neogen SC, produced by Dai-ichi Kogyo Seiyaku Co. Ltd.) is added further and the stainless steel flask is sealed and heated up to 95 degrees C. while continuing stirring with a magnet seal, followed by maintaining the flask at the temperature for 4.5 hours. After cooling, the resulting product is filtered and sufficiently washed with ion exchange water to obtain toner (the toner 1). The average value of a shape factor SF1 of the toner 1 is 120.

(5-2 Toner 2)

As explained below, toner is prepared by using the resin dispersion liquid 1 and the resin dispersion liquid 2, the colorant dispersion liquid and the release agent dispersion liquid which are prepared in advance. The resulting toner has a shape factor SF1 of 112 (the toner 2).

A colorant dispersion liquid is prepared by adding 315 parts by weight of a colorant (C.I. Pigment Blue B15, produced by Dainippon Ink and Chemicals Inc.), 4 parts by weight of a polymer dispersant (Disparon DA-725; a polyester acid amide amine salt; acid value: 20 mg KOH/grams, amine value: 48, produced by Kusumoto Chemicals, Ltd.) and 1 part by weight of a pigment derivative (Solsperse 5000, produced by Zeneca Inc.) to 75 parts by weight of ethyl acetate and then is dissolved and dispersed with a wet fine particle-dispersing machine (a sand mill) to prepare a colorant dispersion liquid. In addition, the solvent is removed in advance from the polymer dispersant.

As the release agents 270 parts by weight of ethyl acetate is added to 30 parts by weight of paraffin wax (melting point: 89 degrees C.) and the resulting product is heated and dissolved followed by rapid cooling to prepare a wax fine particle dispersion liquids As the binder resin, there is used a polyester resin consisting of a bisphenol A propylene oxide adduct, a bisphenol A ethylene oxide adduct and a terephthalic acid derivative (Mw: 22,000, glass transition temperature (Tg): 65 degrees C., melting point (Tm): 105 degrees C.). A liquid is prepared by stirring and mixing 136 parts by weight of the polyester resin, 34 parts by weight of the colorant dispersion liquid and 56 parts by weight of ethyl acetate and then to the liquid is added 75 parts by weight of the wax fine particle dispersion liquid, then the liquid is sufficiently stirred until the liquid becomes homogeneous The resulting liquid is used as an oil phase component.

On the other hand, a calcium carbonate dispersion liquid is prepared by stirring 40 parts by weight of calcium carbonate and 60 parts by weight of water for 15 hours in a ball mill. Next, 124 parts by weight of the calcium carbonate dispersion liquid, 99 parts by weight of a 2% aqueous solution of a sodium salt of carboxymethylcellulose (Serogen BS-H, produced by Dai-ichi Kogyo Seiyaku Cc. Ltd.), and 157 parts by weight of water are stirred for 7 minutes by using a homogenizer (Ultra-Turrax, manufactured by IKA Co., Ltd.) to prepare an aqueous medium.

A mixture suspension liquid is prepared by stirring 345 parts by weight of the aqueous medium and 250 parts by weight of the above-mentioned oil phase component by a homogenizer. Further, the mixture suspension liquid is stirred by a propeller-type stirrer at room temperature under normal pressure for 48 hours to remove the solvents. Next, hydrochloric acid is added and calcium carbonate is removed, followed by washing with water, drying and classifying to obtain solid toner (the toner 2) having an average particle diameter of 6.5 μm. The average value of shape factor SF1 of the resulting toner is 112 (the toner 2).

(5-3 Toner 3)

Suspension polymerization toner is prepared by the method described below. The resulting toner has a shape factor SF1 of 108 (the toner 3).

A mixture is prepared by heating up to 70 degrees C. and dispersing 145 grams of styrene, 55 grams of n-butylmethacrylate, 22 grams of a styrene-diethylaminoethylmethacrylate copolymer (the monomer ratio of 9:1, the number average molecular weight of 22,000) and 12 grams of C.I. Pigment Blue B15, produced by Dainippon Ink and Chemicals Inc. Next, the mixture is mixed for approximately 6 minutes under heating at approximately 70 degrees C. in a container equipped with a high shear force mixing device (TK homomixer, manufactured by Tokushu Kika Kogyo Co., a Ltd.), followed by dissolving 6 grams of azobisisobutylonitrile to prepare a polymerizable mixture.

Separately, a liquid is prepared by dispersing 4 grams of a dispersing agent (Aerosil No. 200) in 1300 ml of water and heated to approximately 70 degrees C. The above-mentioned polymerizable mixture is added to the liquid under stirring by the TK homomixer and the mixture is further stirred at 8500 rpm for approximately 60 minutes. Thereafter, the polymerizations is completed while this mixture system is being stirred with a paddle agitating blade. Subsequently, the dispersing agent is removed with sodium hydroxide, followed by washing with water, filtering and drying too obtain cyan color Loner (the toner 3). The resulting cyan color toner has a number average particle diameter of 9.5 μm. The average value of shape factor SF1 of the resulting toner is 108 (the toner 3).

(5-4 Toner 4)

Toner is prepared by the spray dryer method described below. The average value of a shape factor SF1 of the resulting toner is 125 (the toner 4).

A mixture is prepared by mixing, melting and kneading 95 parts by weight of polyester (XPE1485, produced by Mitsui Toatsu Chemicals Inc.), 5 parts by weight of polypropylene wax (Biscol 550P, produced by Sanyo Chemical Industries, Ltd.), 0.5 parts by weight of a charge control agent (S-34, produced by Orient Chemical Industries, Ltd.) and 3.5 parts by weight of a colorant (Carbon Black MA-100, produced by Mitsubishi Chemical Corp.) and then the mixture is cooled and roughly pulverized by a hammer mill.

Thereafter, the resulting mixture is finely pulverized by a jet mill. Further, the resulting fine powders are subjected to the ensphering process by using a spray dryer (the powders are sprayed in a hot air flow under the conditions of hot air temperature of 200 degrees C. and average retention time of 1.1 seconds) and then the excessive fine powder area and the coarse powder area are removed by a wind power classifier. And then 0.3% by weight of an external additive (Silica R-974, produced by Nippon Aerosil Co., Ltd.) is subjected to dry mixing by a Henschel mixer, followed by removing the excessive coarse powder area with an oscillating sieve having a mesh size of 45 μm to obtain black toner having a volume average particle diameter of approximately 9.8 μm (the toner 4). The average value of a shape factor SF1 of the resulting toner is 125 (the toner 4).

(5-5 Toner 5)

Toner is prepared by the mechanical method described below. The resulting toner has a shape factor SF1 of 128 (the toner 5).

A mixture is prepared by mixing 100 parts by weight of an binder resin (a styrene-acryl copolymer), 10 parts by weight of an colorant (a magenta pigment) and 5 parts by weight of a release agent (carnauba wax) and by melting and kneading in a kneader at 150 degrees C. After cooling, the mixture is roughly pulverized in a hammer mill and is further finely pulverized by a jet mill pulverizer, followed by classifying by a wind power classifier to obtain indefinite shape particles. The particles have a volume average particle size of approximately 8.0 μm. The indefinite shape particles are ensphered using a mechanical ensphering device (Hybridizer NHS-1, manufactured by Nara Machinery Co., Ltd. The average value of a shape factor SF1 of the resulting magenta color toner is 128 (the toner 5).

(5-6 Toner 6)

Toner after being pulverized and finely pulverized but before being subjected to the ensphering process by a spray dryer method in the preparation of the toner 4 is used as toner 6. The toner 6 has a shape factor SF1 of 145.

(5-7 Toner 7)

Toner which is adjusted to have a shape factor SF1 of 135 by shortening the process time of the mechanical ensphering device of the toner 5 is used as toner 7.

Examples 1 to 5 and Comparative Examples 1 and 2

The following evaluations are performed using the above-mentioned seven (7) kinds of Loner (toner 1 to toner 7).

The toner cartridges 13 in which each of the above-mentioned 7 kinds of toner are filled are subjected to an accelerated test in which the agitator 140 is rotated at approximately 250 rpm by the external motor and each toner in the toner cartridges 13 is stirred under a high load.

After rotating the agitator 140 for one hour under the above-mentioned conditions, the feed toner storing container 104 and the partition member 117 are disassembled and then the presence or absence of the toner intruded into the bearing portion 117*a* disposed on the partition member 117 and the presence or absence of the adhesion of the toner are observed. In addition, after rotating the agitator 140 for 3 hours under the same conditions, the presence or absence of the toner intruded into the bearing portion 117*a* and the presence or absence of the adhesion of the toner are observed. The results are shown in Table 1.

Further, the toner cartridges 13 which are subjected to the accelerated test are each mounted on the image forming apparatus shown in FIG. 1, the half-tone image having a printing ratio of 30% is outputted and the presence or absence of the image defect due to the agglomerated or fused toner is examined. The image evaluation is based on the following criteria. The results are shown in Table 1.

A: No image defects
B: 1 or more and 3 or less image defects
C: More than 3 and 6 or less image defects
D: More than 6 and 9 or less image defects
E: 10 or more image defects

TABLE 1

| | | TONER | | RESULT OF ACCELERATED TEST | | | |
|---|---|---|---|---|---|---|---|
| | | | | 1 HOUR | | 3 HOURS | |
| | | KINDS OF TONER | SHAPE FACTOR SF1 | IMAGE DEFECT | INTRUSION OF TONER ADHESION OF TONER | IMAGE DEFECT | INTRUSION OF TONER ADHESION OF TONER |
| EXAMPLES | 1 | TONER 1 | 120 | A | NO | A | NO |
| | 2 | TONER 2 | 112 | A | NO | A | NO |
| | 3 | TONER 3 | 108 | A | NO | A | NO |
| | 4 | TONER 4 | 125 | A | NO | A | VERY FEW |
| | 5 | TONER 5 | 128 | A | NO | A | VERY FEW |
| COMPERATIVE EXAMPLES | 1 | TONER 6 | 145 | C | VERY FEW | D | A LITTLE INTRUSION AND A LITTLE ADHESION |
| | 2 | TONER 7 | 135 | B | NO | C | LITTLE INTRUSION |

From the results shown in the Table 1, it is found that in the case of the toner cartridges 13 (Examples 1 to 5) in which the toners prepared in the present examples are filled, the toner conveying property in the container is secured and the intrusion of the toner into the bearing portion 117*a* is reduced, thereby preventing the occurrence of the agglomeration of the toner intruded into the bearing portion 117*a*, the adhesion of the toner and the like.

In addition, it is found that no image defects due to the toner which is agglomerated and adhere in the toner cartridge 13 are observed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners stilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner cartridge system comprising:

a toner cartridge and a toner, the toner cartridge including:

a toner storing container of a rectangular shape having a toner feeding opening in an angular portion thereof;

a stirring conveying member that is disposed so as to rotate in a predetermined rotation direction in the toner storing container and stirs and conveys the toner in the toner storing container toward the toner feeding opening, wherein the stirring conveying member includes a shaft and an agitator film, the agitator film including a plurality of slits having a predetermined slope angle, a concave portion, and cuts formed at the tip of the agitator film;

a waste toner storing container that stores reclaimed toner; and a partition member, held by the toner storing container, that partitions the toner cartridge into the toner storing container and the waste toner storing container, a bearing portion of the partition member axially supporting the shaft of the stirring conveying member extends to an inside of the waste toner storing container, the toner stored in the toner storing container having an average value of a shape factor (SF1) defined by a following equation (1) of about 130 or less, $$SF1=100\times(\pi/4)\times(ML^2/S) \quad (1)$$

wherein π(pi) represents circle ratio, ML represents an absolute maximum length of a toner particle, and S represents a projected area of the toner particle.

2. The toner cartridge according to claim 1, wherein the toner storing container has an area in a toner feeding side that is disposed inside the toner storing container and is formed in a circular arc shape along the longitudinal direction of the side where the toner feeding opening is located.

3. The toner cartridge according to claim 1, wherein the average value of the shape factor (SF1) is about 110 to about 130.

4. The toner cartridge according to claim 1, wherein the bearing portion is formed as a cylindrical bag structure having an opening portion and a bottom portion, and the stirring conveying member is supported by inserting the rotating shaft into the opening portion of the bearing portion.

5. The toner cartridge according to claim 4, wherein a tip portion of the rotating shaft is housed in the bearing portion, and a clearance between a tip end of the tip portion housed in the bearing portion and the bottom portion of the bearing portion is about 0.1 mm to about 1.0 mm.

6. The toner cartridge according to claim 1, wherein the shaft is an axis portion that is axially supported so as to rotate in the toner storing container; and the agitator film is a stirring conveying portion that is disposed on the axis portion and distorted by pressure applied by the toner stored in the toner storing container, and a ratio (L2/L1) of a length L2 of a tip portion housed in the bearing portion to a length L1 of a portion in the toner storing container of the axis portion is not less than about 0.1.

7. The toner cartridge according to claim 6, wherein the ratio (L2/L1) of the length L2 of the tip portion housed in the bearing portion to the length L1 of the portion in the toner storing container of the axis portion is not less than about 0.2.

8. The toner cartridge according to claim 1, wherein the difference between the inner diameter of the bearing portion of the partition member that axially supports the rotating shaft of the stirring conveying member and extending into inside of the waste toner storing container and the outer diameter of the rotating shaft of the stirring conveying member is in the range of from about 0.05 to about 0.2 mm.

9. The toner cartridge according to claim 1, wherein the bearing portion is integrally disposed on the partition member.

* * * * *